United States Patent [19]

Sargent et al.

[11] 4,217,668

[45] Aug. 19, 1980

[54] PORTABLE TOILET

[75] Inventors: Charles L. Sargent, Ann Arbor; John A. Hoffman, Brighton; John M. Antos; Arthur W. Henke, both of Ann Arbor, all of Mich.

[73] Assignee: Thetford Corporation, Ann Arbor, Mich.

[21] Appl. No.: 77,175

[22] Filed: Sep. 20, 1979

[51] Int. Cl.[3] ..... E03D 5/012; E03D 5/01; E03D 11/10

[52] U.S. Cl. ..... 4/321; 4/323; 4/434

[58] Field of Search ..... 4/321, 115, 323, 322, 4/116, 434, 437, 349, 350, 431, 422, 300, 419, 420

[56] References Cited

U.S. PATENT DOCUMENTS

| | | | |
|---|---|---|---|
| 3,570,018 | 3/1971 | Sargent et al. | 4/115 |
| 3,801,991 | 4/1974 | Fulton et al. | 4/116 X |
| 3,851,339 | 12/1974 | Flinner et al. | 4/434 |
| 3,860,973 | 1/1975 | Uyeda et al. | 4/332 |
| 3,939,430 | 4/1976 | Miller et al. | 4/321 |
| 3,939,501 | 2/1976 | Sargent | 4/115 X |
| 4,145,773 | 3/1979 | Sargent et al. | 4/321 |
| 4,162,548 | 7/1979 | Groombridge et al. | 4/329 X |
| 4,180,876 | 1/1980 | Sargent et al. | 4/321 |

FOREIGN PATENT DOCUMENTS

| | | | |
|---|---|---|---|
| 1048705 | 2/1979 | Canada | 4/321 |

*Primary Examiner*—Henry K. Artis
*Attorney, Agent, or Firm*—Olsen and Stephenson

[57] ABSTRACT

A portable toilet of the type having two vertically stacked sections, the lower section (12) being a holding tank, and the upper section (14) including a toilet bowl (22), a water tank (26) for storage of water for flush purposes, and flush apparatus (32) for flushing the toilet bowl. Handles (78) and (80) are provided for separately carrying the lower section (12) and the upper section (14), the handles being arranged so that they form a unitary handle for carrying the toilet (10) without the need of a clasping mechanism for holding the sections together. An improved flush apparatus (32) including the flush bulb (84) is provided so that priming of the flushing system is unnecessary. A valve assembly (46) is mounted within the confines of the lower section (12) by providing a planar member (58) that is a part of the valve body (56) and can be inserted through an opening (72) in the top wall of the lower section (12) for attachment to the top wall within the holding tank.

15 Claims, 7 Drawing Figures

PORTABLE TOILET

TECHNICAL FIELD

The present invention relates to self-contained portable toilets of the type having two vertically stacked sections, the lower section being a holding tank and the upper section including a toilet bowl, flush water tank and flush apparatus; and it relates more particularly to improvements in portable toilets of this type.

BACKGROUND ART

Examples of known portable toilets to which the present invention relates are disclosed in U.S. Pat. No. 3,570,018, patented Mar. 16, 1971 in the names of Sargent et al; U.S. Pat. No. 3,949,430, patented Apr. 13, 1976 in the names of Miller et al; and U.S. Pat. No. 4,145,773, patented Mar. 27, 1979 in the names of Sargent et al.

Portable toilets of this character have holding tanks on which are removably mounted upper units which contain among other items, the toilet bowl, a flush water storage tank and flush apparatus for flushing waste material from the bowl into the holding tank. It is the conventional practice in each of the toilets disclosed in U.S. Pat. Nos. 3,949,430 and 4,145,773 to provide a valve assembly that is located within the holding tank for opening and closing the tank inlet port which is in communication with the outlet port of the toilet bowl. It is also known to provide a vent means for the holding tank to equalize the atmospheric and holding tank pressures before opening and closing the inlet port to the holding tank, as is disclosed in U.S. Pat. No. 4,145,773.

In portable toilets of this character, individual handles are provided for carrying the holding tank section and the upper section separately, and the sections can be carried in stacked-together relationship by clamping the sections together and then carrying the toilets by either one or the other of the handles. These toilets necessarily require clamping mechanisms of sturdy construction to retain the sections together if they are to be transported in this manner under adverse conditions.

Relatively simple flush apparatus is also provided in the prior art toilets wherein hand actuated bellows pumps are located in an upper portion of the upper section adjacent to the toilet seat for pumping the flush water from the storage tank into the toilet bowl. Because of the portable nature of the toilets, the column of water in the conduit from the flush water storage tank to the pump is often broken so that before the toilet can be flushed the pump must be primed by repeated pumping action of the bellows pump.

SUMMARY OF THE INVENTION

The present invention provides a self-contained portable toilet that embodies features which enable it to be produced at a lower cost and as a more simplified lightweight toilet that overcomes some of the inadequacies of the prior art without diminishing from the generally high quality of service and performance that can be derived from the portable toilets disclosed in the above-cited United States patents.

According to one form of the present invention, a portable toilet is provided comprising a portable lower holding tank section and a portable upper seat section removably stacked thereon. The seat section has walls defining the flush water storage tank and a toilet bowl which has an outlet port at its bottom and has flush apparatus for discharging flush water from the storage tank to the bowl. The holding tank has a top wall and side and bottom walls forming a closed receptacle with an inlet port in its top wall in registry with the outlet port of the toilet bowl. The holding tank has a valve assembly that defines the inlet port and is operable for opening and closing the inlet port. One of the features of this portable toilet is that each of the sections has handles for carrying purposes, the handles being in engagement with each other at a location essentially in the plane in which the parting surfaces of the sections are located so that the handles function as a unitary handle for carrying purposes when the sections are in stacked-together relationship. The construction and arrangement is such that when stacked together, the outlet port of the toilet will extend in registry into the inlet port of the holding tank and the unitary handle assembly can then be used for conveniently carrying the assembled portable toilet without any forces acting to separate them as they are being transported in this manner. Thus, clasp mechanisms for holding the sections together can be eliminated without detrimental effects.

Another feature of the present invention is that the outlet port and the inlet port of the respective sections may have cooperating means for snap-fitting the sections together in their registered positions so as to further cooperate in holding the sections together. In this form of the invention, it is preferred that the outlet port have radially outwardly projecting lip segments at space intervals around its outer circumference and the inlet port have radially inwardly projecting lip segments at spaced intervals around its inner circumference, and that these lip segments have resilient properties so that they can be snap-fitted together and snap apart when desired, thereby cooperating in holding the sections together by very low cost means.

Still another feature of the present invention is that the flush apparatus comprises a nozzle in communication with the flush water storage tank for discharging the flush water into the bowl, a flush bulb and a conduit in communication with the flush bulb and the nozzle, the flush bulb being located at an elevation near the bottom of the flush water storage tank so that when flush water is in the flush water storage tank, a head of water will remain on the flush bulb to ensure an immediate response of flush water to the bowl when the flush bulb is squeezed.

In this form of the invention, it is preferred that a cavity be defined between the upper and lower sections and that the flush bulb be located in this cavity. in a preferred location, the bulb will be in the same cavity that is conventionally utilized for the handle of the valve assembly which opens and closes the inlet port to the holding tank. This cavity normally is in the front side walls of the sections where the valve handle and bulb can be conveniently reached by the user of the portable toilet.

Still another feature of the present invention is the construction and arrangement that is provided for mounting the valve assembly within the confines of the holding tank section. For reasons set forth in the prior U.S. Pat. No. 3,949,430, it is desirable to locate the valve assembly within the confines of the holding tank. This arrangement creates certain problems of constructing and assembling the components of the holding tank section. To overcome these difficulties and to simplify the procedures for assembling the holding tank section, a unique construction and arrangement has been provided wherein the top wall of the holding tank section has an elongated opening therein and the valve assembly includes a valve body that has an elongated upper planar member with an upper wall area greater than the area of the elongated opening, the member being connected to the top wall of the holding tank in sealed relation thereto under the edge of the opening. The elongated member and the elongated opening have dimensions so that during installation the planar member can be inserted through the opening with the transverse axis of the member aligned generally with the longitudinal axis of the opening after which the member can be connected to the inner wall of the holding tank to cover the opening. This member defines the inlet port, and when mounted as indicated, the inlet port will then be properly located so as to be in registry with the outlet port of the toilet bowl when the upper seat section is stacked on the holding tank section.

In this form of the invention, the elongated planar member also has a vent port means located adjacent to the inlet port for venting the holding tank. The valve assembly includes a blade for opening and closing the inlet port and a vent port closure element that is moveable as an incident to movements of the blade to open and close the vent port means. The vent port means is broadly disclosed in U.S. Pat. No. 4,145,773 and one of the features of the present invention is the unique arrangement for incorporating a vent port means in the top wall of the holding tank so that it can be opened and closed as an incident to movement of the valve blade of the valve assembly. By virtue of the vent port means being located in the valve assembly, a simplified blow molding operation can be carried out for forming the holding tank.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
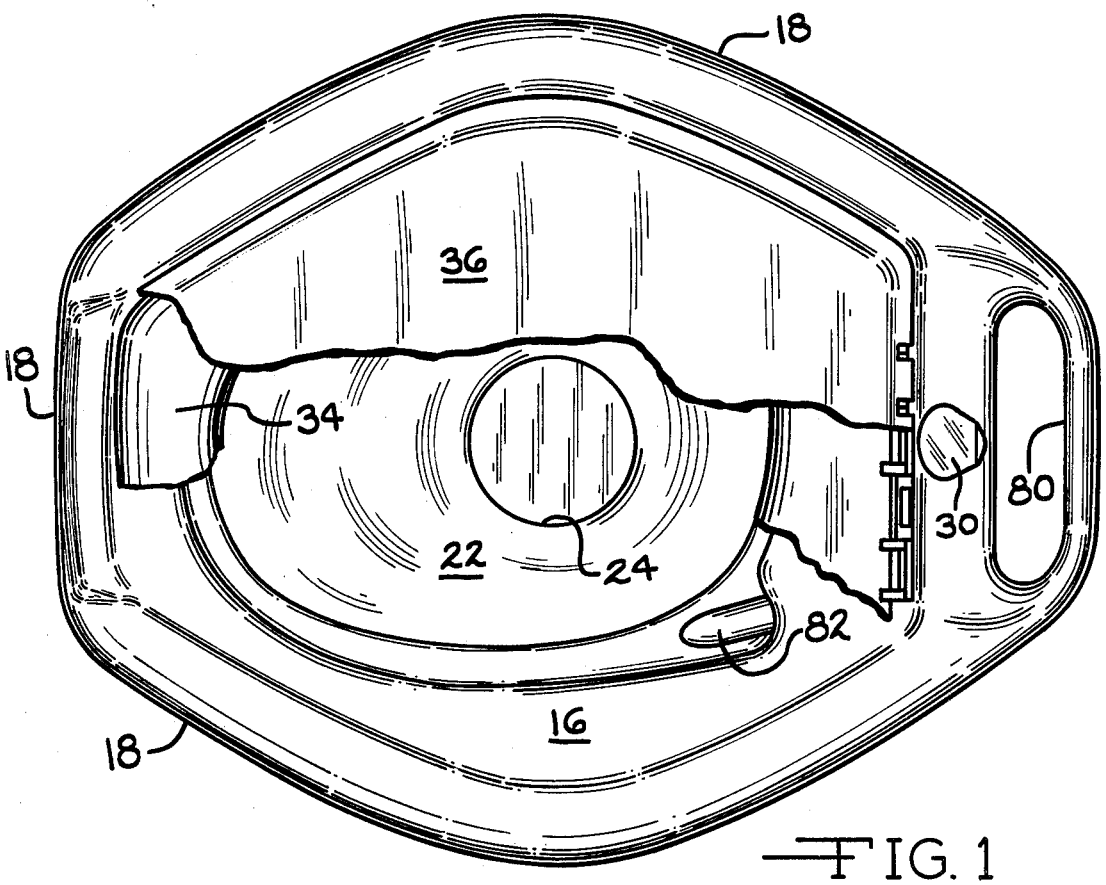
FIG. 1 is a top plan view of a portable toilet embodying one form of the present invention, with portions of the toilet cover and toilet seat removed for illustration purposes.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The portable toilet 10 comprises the lower holding tank section 12 and the upper seat section 14 removably mounted or stacked thereon. The upper seat section 14 is molded of a suitable plastics material so as to have a top wall 16, side walls 18 and a bottom wall 20. The upper seat section 14 has additional walls that define the toilet bowl 22 which has an outlet port 24 at its bottom and a flush water storage tank 26 that extends around the exterior of the bowl 22. A fill opening 28 which is usually closed by the closure cap 30 is provided for filling the flush water storage tank 26. Flush apparatus 32 which will subsequently be described in greater detail is provided for pumping flush water from the storage tank 26 to the interior of the bowl 22. In the conventional manner, a toilet seat 34 and a cover 36 are hingedly connected to the top wall 16.

The lower holding tank section 12 has a top wall 38, side walls 40 and a bottom wall 42 forming a closed receptacle with an inlet port 44 in its top wall in registry with the outlet port 24 of the upper seat section 14. A discharge spout and closure cap 45 are provided for emptying the holding tank section 12. A slide valve assembly 46 is mounted on the holding tank section 12 and defines the inlet port 44. The slide valve assembly 46 includes the flat blade or valve element 48 which in the present embodiment is supported within the confines of the holding tank section 12 for movement in a horizontal plane perpendicularly to the axis of the inlet port 44 for closing the port and sealing the interior of the holding tank 12 from the environment. The slide valve assembly 46 includes some of the features disclosed in the prior U.S. Pat. No 3,949,430 and U.S. Pat. No. 4,145,773 to which reference is made for more detailed descriptions and explanations of these features.

Briefly, the slide valve assembly 46 includes a blade or valve element 48 to which a handle 50 is attached, the handle 50 extending through an opening in the front side wall 18 in a sealed relationship. Because the handle 50 extends into the interior of the holding tank 12, a protective bellows 52 is fitted over the shaft of the handle and is secured in sealed relationship thereto. In the manner similar to that set forth in the aforesaid U.S. Pat. No. 3,949,430, the blade 48 is supported between guide surfaces 54 for movement between its closed position and its open position.

The valve body 56 of the valve assembly 46 is formed of an elongated upper planar member 58 to which is attached the retainer member 60. The planar member 58 includes and defines the inlet port 44, and the retainer member 60 includes and defines the vertical guide surfaces 54. Also, the planar member 58 provides a support for the seal ring 62 which is adapted to engage the lower end of the annular outlet 24 of the toilet bowl 22.

Figure 3:
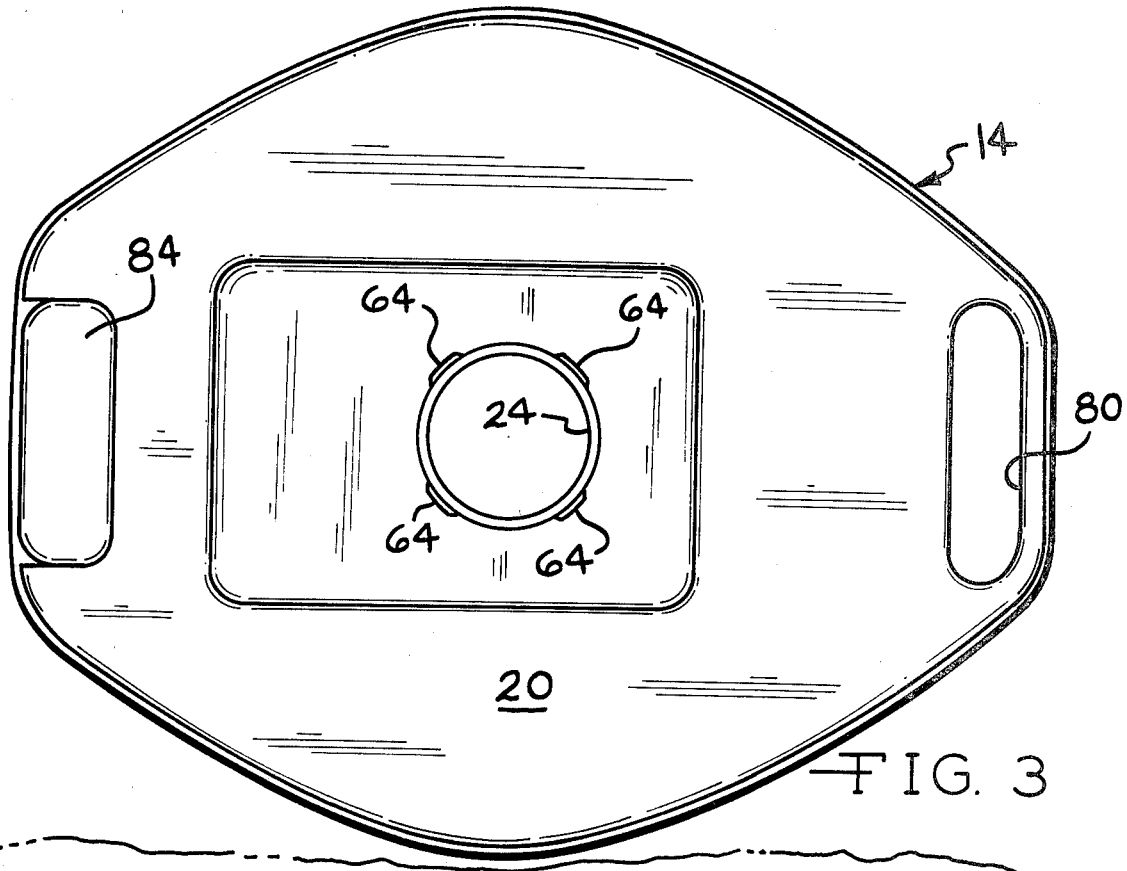
FIG. 3 is a bottom plan view of the portable upper seat section.
Figure 4:
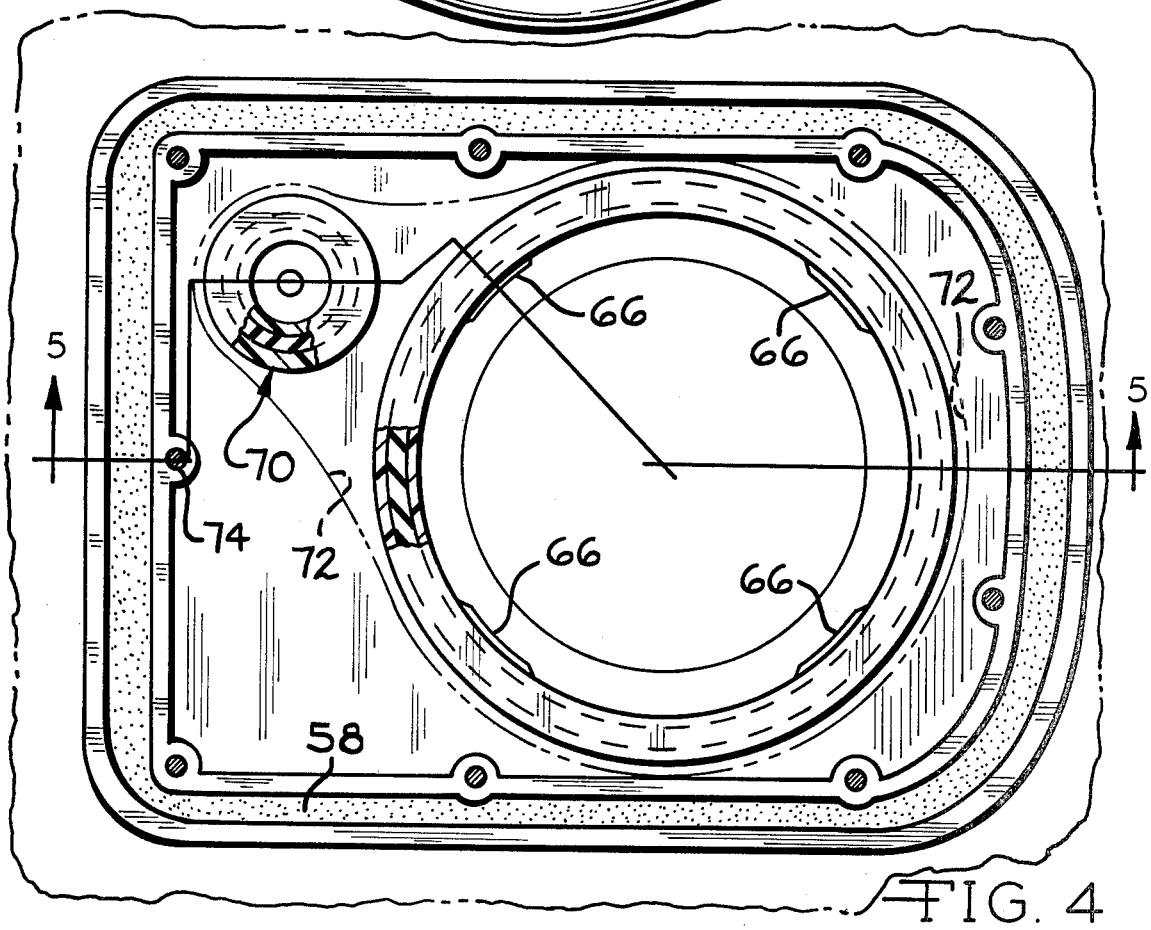
FIG. 4 is an enlarged fragmentary detail taken essentially on the lines 4—4 of FIG. 2.
Figure 6:
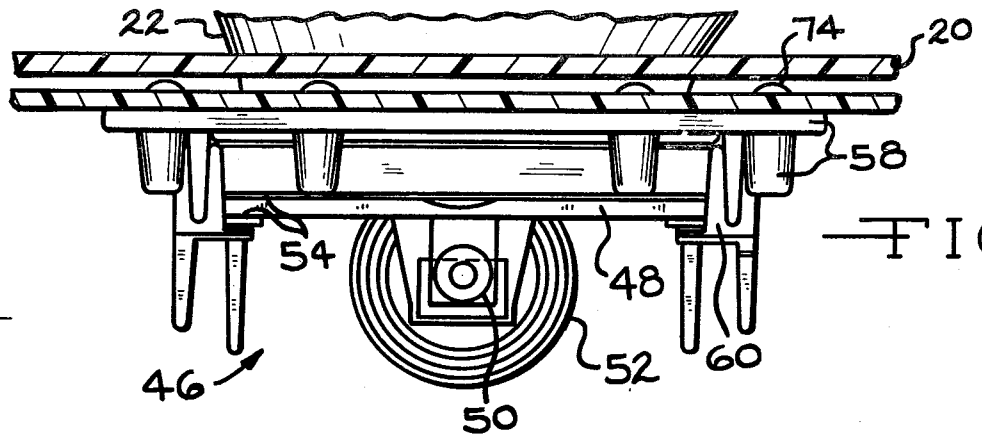
FIG. 6 is a fragmentary section taken on the lines 6—6 of FIG. 5.
Figure 5:
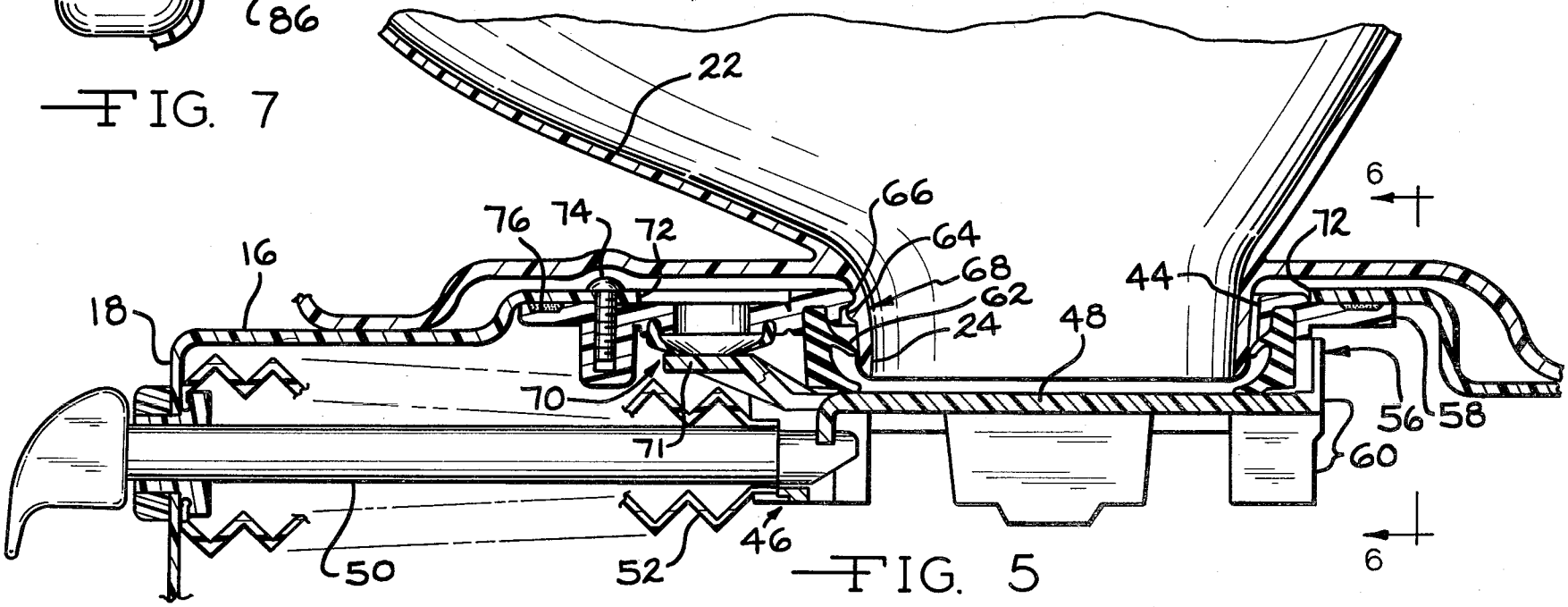
FIG. 5 is an enlarged fragmentary section taken essentially on the lines 5—5 of FIG. 4 showing details of the valve assembly and the snap-fit connection between the inlet and outlet ports.
Figure 7:
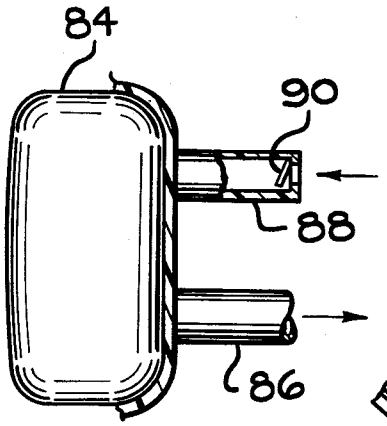
FIG. 7 is a fragmentary view, partly in section, taken on the lines 7—7 of FIG. 2, showing details of the flush bulb.

As can be seen best in FIGS. 3 and 5, the outlet port 24 has radially outwardly projecting lip segments 64 at spaced intervals around its outer circumference, and similarly, as seen in FIGS. 4 and 5, the inlet port 44 has radially inwardly projecting lip segments 66 at spaced intervals around its inner circumference. Only one pair of the cooperating lip segments 66 is shown in FIG. 5, but it is to be understood that an appropriate number of such segments 66 equal to and opposite from lip segments 64 are to be provided so that the outlet port 24 can be pressed into the inlet port 44, as shown in FIG. 5, with the lip segments 66 snap-fitted over the corresponding lip segments 64 of the inlet port 44. The toilet bowl 22 and the planar member 58 are made of a suitable plastics material so that they have resilient properties to enable the bowl 22 to deflect for snap-fitting the outlet port 24 into the inlet port 44, as shown. When it is desired to remove the upper seat section 14 from the lower holding tank section 12, this can be done merely by lifting the upper section 14 and by virtue of the resilient properties of the plastics material, the snap-fitted cooperting means 68 will permit the sections to be separated.

The elongated planar member 58 also has a vent port means 70 located adjacent to the inlet port 44 for use in venting the holding tank for a purpose that is more specifically set forth in U.S. Pat. No. 4,145,773. For this purpose, the valve assembly 46 includes vent port closure element 71 that is an integral part of the blade 48 and is moveable as an incident to movements of the blade to open the vent port means 70 prior to the opening of the inlet port 44. A detailed description of the vent port means 70 can be found in prior U.S. Pat. No. 4,145,773.

As can be seen best in FIGS. 4 and 5, the elongated planar member 58 has an area sufficiently large so that it covers the opening 72 formed in the top wall 16 of the holding tank 12. It is secured to the inside of the top wall 16 by means of a plurality of screws 74 and a suitable sealing material 76 is provided to assure a tight seal at this connection. The elongated planar member 58 is dimensioned with respect to the opening 72 so that during initial installation, the planar member can be inserted through the opening 72 with the transverse axis of the coplanar member 58 aligned generally with the longitudingl axis of the opening 72, after which the member 58 can be connected to the inner wall of the holding tank section 12 to cover the opening, and the member 58 will then define the inlet port 44 which will be located to receive the outlet port of the toilet bowl 22.

Figure 2:
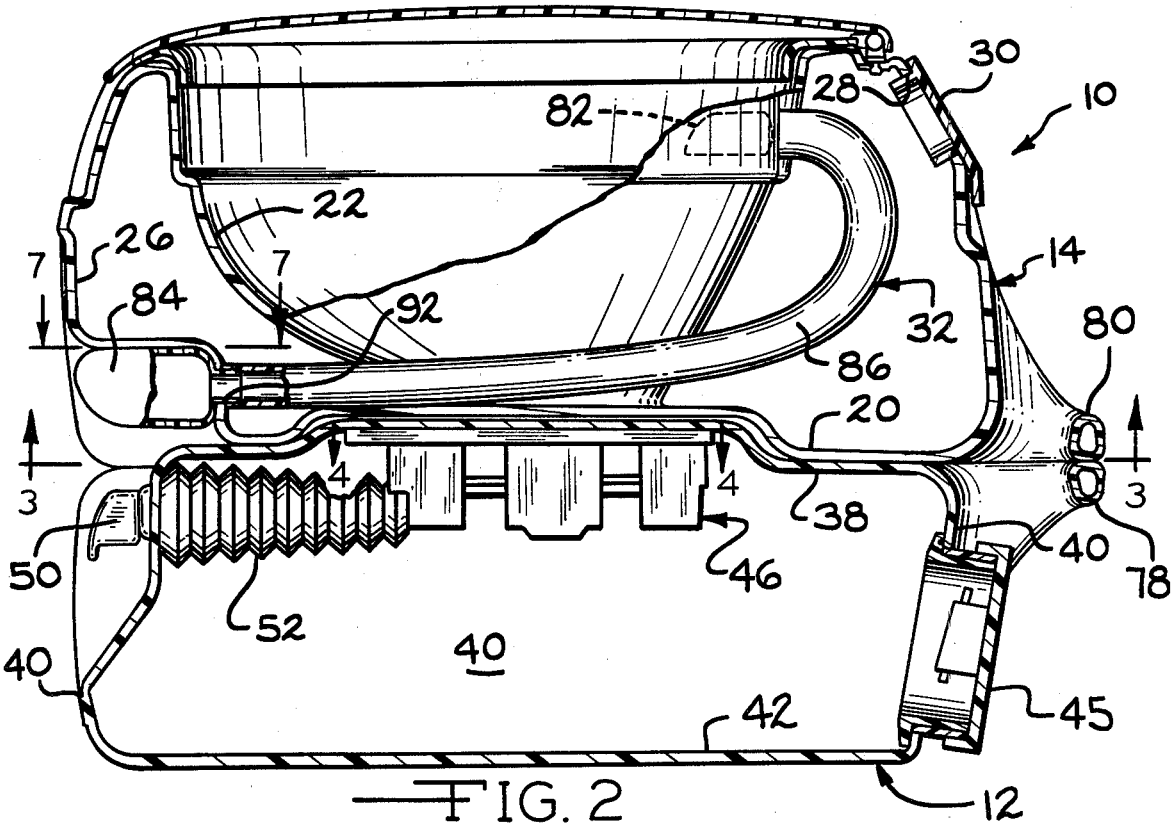
FIG. 2 is a vertical section of the embodiment of the invention shown in FIG. 1, a part of the section being on the longitudinal centerline of the unit and the remainder being in different planes to facilitate illustration of the interior of the portable toilet.

As can be seen best in FIG. 2, the holding tank section 12 has a handle 78, and the upper seat section 14 has a handle 80. These handles can be used to individually transport the sections 12 and 14, and when the sections are stacked together as shown in FIG. 2, the handles are located so that they are in engagement and are essentially in a horizontal plane passing generally through the parting surfaces of the upper and lower sections 14 and 12. Thus, when it is desired to carry the complete portable toilet 10, the handles 78 and 80 form a unitary handle allowing the toilet to be carried as a unit without forces existing that tend to separate the upper and lower sections. At this time, the cooperating means 68 snap-fit the sections together to assist further in holding them together while being transported and also at other occasions when the portable toilet 10 may be subjected to movements.

Reference is next made to FIGS. 1–3 and 7 for a description of the unique flush apparatus 32. As there shown, the flush apparatus 32 includes a nozzle 82, a flush bulb 84 and a conduit 86 in communication at its ends with the nozzle 82 and flush bulb 84. The flush bulb 84 also has a fitting 88, containing a suitable check valve 90 that is in communication with the flush water storage tank 26, adjacent to the bottom of the latter. By virtue of this arrangement, when flush water is in the storage tank 26, a head of water will be on the flush bulb 86 assuring an immediate supply of water for discharge through conduit 86 to the nozzle 82. Thus, priming the flush system after non-use of the portable toilet 10 is unnecessary because the flush apparatus 32 will always have a head of water on the flush bulb 84 whenever the portable toilet 10 is charged with flush water and is in position for use. If desired, a check valve, not shown, may be located at the lower end of conduit 86 where it is connected to the fitting 92.

In the flush apparatus 32, the nozzle 82 is located adjacent to the top of the bowl 22 at the upper end of the conventional spiral ledge therein, but it is to be understood that other nozzle arrangements can be employed. For example, the nozzle 82 can be shaped so that it extends over the top edge of the bowl 22 and discharges onto the ledge in the same manner. This arrangement serves to assure that an air break in in the flush circuit so that syphoning of water from the flush water tank 26 to the bowl 22 will not occur when the upper section 14 is being carried. Similarly, in the illustrated embodiment, the conduit 86 extends rearwardly adjacent to the rear side wall 18 so that when the toilet 10 is being carried by handles 78, 80 and air break will exist in conduit 86 above the water line in the flush water tank 26 to prevent syphoning of water from the tank through the nozzle 82.

It is claimed:

1. A portable toilet comprising a portable lower holding tank section and a portable upper seat section removably stacked thereon, said seat section having walls defining a flush water storage tank and a toilet bowl which has an oulet port at its bottom, and having flush apparatus for discharing flush water from the storage tank into the bowl, said holding tank section having a top wall and side and bottom walls forming a closed receptacle with an inlet port in its top wall in registry with said outlet port, and having a valve assembly that defines said inlet port and is operable for opening and closing said inlet port, characterized in that said holding tank and seat sections have parting surfaces respectively at their top and bottom walls which are located generally in a flat plane, said sections having handles for carrying purposes, said handles being in engagement with each other at a location essentially in said plane so that they function as a unitary handle for the purpose of carrying the portable toilet with the sections in stacked-together relationship, said sections then also being joined together with said outlet port extending in registry into said inlet port.

2. A portable toilet according to claim 1, characterized in that said outlet port and said inlet port have cooperating means for snap-fitting said sections together in their registered positions, said cooperating means functioning with said unitary handle so that said sections are retained together when the unitary handle is used to carry the toilet.

3. A portable toilet according to claim 2, characterized in that said sections have resilient properties, and said outlet port has radially outwardly projecting lip segments at spaced intervals around its outer circumference and said inlet port has radially inwardly projecting lip segments at spaced intervals around its inner circumference, the inlet and outlet lip segments cooperating to retain the inlet and outlet ports together and being releasable for separating the sections by virtue of the resilient properties of the sections.

4. A portable toilet according to claim 1, characterized in that said flush apparatus comprises a nozzle for discharging flush water into the bowl, a flush bulb, and a conduit in communication with said flush bulb and said nozzle, said flush bulb having an inlet fitting in communication with the bottom of said flush water storage tank and an outlet fitting in communication with said conduit, said flush bulb being mounted adjacent to the bottom of said flush water storage tank so that when flush water is in the flush water storage tank a head of water will remain on said flush bulb to ensure an immediate response of flush water to the bowl when the flush bulb is squeezed.

5. A portable toilet according to claim 4, characterized in that said sections have a cavity defined between them and said flush bulb is mounted in said cavity.

6. A portable toilet according to claim 5, characterized in that said cavity extends inward from the front side walls of said sections, and said valve assembly includes a valve handle located in said cavity and extending into said holding tank section and a valve blade connected to said handle for movement to open and to close said inlet port, said flush bulb being located in the cavity above said valve handle.

7. A portable toilet comprising a portable lower holding tank section and a portable upper seat section removably stacked thereon, said seat section having walls defining a flush water storage tank and a toilet bowl which has an outlet port at its bottom, and having flush apparatus for discharging flush water from the storage tank into the bowl, said holding tank section having a top wall and side and bottom walls forming a closed receptacle with an inlet port in its top wall in registry with said outlet port, and having a valve assembly for opening and closing said inlet port, characterized in that said flush apparatus comprises a nozzle for discharging flush water into the bowl, a flush bulb, and a conduit in communication with said flush bulb and said nozzle, said flush bulb having an inlet fitting in communication with the bottom of said flush water storage tank and an outlet fitting in communication with said conduit, said flush bulb being mounted adjacent to the bottom of said flush water storage tank so that when flush water is in the flush water storage tank a head of water will remain on said flush bulb to insure an immediate response of flush water to the bowl when the flush bulb is squeezed.

8. A portable toilet according to claim 7, characterized in that said sections have a cavity defined between them, and said flush bulb is mounted in said cavity.

9. A portable toilet according to claim 8, characterized in that said cavity extends inward from the front side walls of said sections, and said valve assembly includes a valve handle located in said cavity and extending into said holding tank section and a valve blade connected to said handle for movement to open and to close said inlet port, said flush bulb being located in the cavity above said valve handle.

10. A portable toilet according to claim 7, characterized in that said outlet port and said inlet port have cooperating means for snap-fitting said sections together in their registered positions.

11. A portable toilet comprising a portable lower holding tank section and a portable upper seat section removably stacked thereon, said seat section having walls defining a flush water storage tank and a toilet bowl which has an outlet port at its bottom, and having a flush apparatus for discharging flush water from the storage tank into the bowl, said holding tank section having a top wall and side and bottom walls forming a closed receptacle with an inlet port in its top wall in registry with said outlet port, and having a valve assembly that defines said inlet port and is operable for opening and closing said inlet port, characterized in that said outlet port and said inlet port have cooperating means for snap-fitting said sections together in their registered positions, said cooperating means being the only mechanically interlocking elements between said sections.

12. A portable toilet according to claim 11, characterized in that said sections have resilient properties, and said outlet port has radially outwardly projecting lip segments as spaced intervals around its outer circumference and said inlet port has radially inwardly projecting lip segments at spaced intervals around its inner circumference, the inlet and outlet lip segments cooperating to interlock the inlet and outlet ports together and being releasable for separating the sections by virtue of the resilient properties of the sections.

13. A portable toilet comprising a portable lower holding tank section and a portable upper seat section removably stacked thereon, said seat section having walls defining a flush water storage tank and a toilet bowl which has an outlet port at its bottom, and having flush apparatus for discharging flush water from the storage tank into the bowl, said holding tank section having a top wall and side and bottom walls forming a closed receptacle with an inlet port in its top wall in registry with said outlet port, and having a valve assembly that defines said inlet port and is operable for opening and closing said inlet port, characterized in that said top wall has an elongated opening therein, and said valve assembly includes a valve body that has an elongated upper planar member with an upper wall area greater than the area of said elongated opening, said member being connected to said top wall of the holding tank in sealed relation thereto under the edge of said opening, said elongated planar members and said elongated opening having dimensions so that during installation the planar member can be inserted through said opening with the transverse axis of the member aligned generally with the longitudinal axis of the opening, after which the member can be connected to the inner wall of the holding tank to cover said opening, said member also defining said inlet port.

14. A portable toilet according to claim 13, characterized in that said elongated planar member has a vent port means located adjacent to said inlet port for venting said holding tank, and said valve assembly includes a blade for opening and closing said inlet port and a vent port closure element movable as an incident to movements of said blade to open said vent port means prior to the opening of said inlet port and to close said vent port means after the closing of said inlet port.

15. A portable toilet according to claim 13, characterized in that said elongated planar member and said toilet bowl have cooperating means at said outlet port and said inlet port for releasably snap-fitting the planar member to said toilet bowl when the seat section is placed in registered position on said holding tank section.

* * * * *